United States Patent [19]

Romer et al.

[11] 4,177,733

[45] Dec. 11, 1979

[54] SPIN STABILIZED PROJECTILE ASSEMBLY

[75] Inventors: Rudolf Romer, Kaarst; Manfred Moll, Dusseldorf; Christian Jaeneke, Aachen, all of Fed. Rep. of Germany

[73] Assignee: Rheinmetall GmbH., Dusseldorf, Fed. Rep. of Germany

[21] Appl. No.: 834,496

[22] Filed: Sep. 19, 1977

[30] Foreign Application Priority Data

Sep. 20, 1976 [DE] Fed. Rep. of Germany ..... 2642222

[51] Int. Cl.[2] ..... F42B 13/02

[52] U.S. Cl. ..... 102/93; 102/DIG. 10

[58] Field of Search ..... 102/93, DIG. 10

[56] References Cited

U.S. PATENT DOCUMENTS

| | | | |
|---|---|---|---|
| 405,690 | 6/1889 | Ball | 102/93 |
| 2,983,224 | 5/1961 | Prosen et al. | 102/93 |
| 3,621,781 | 11/1971 | Johnsen | 102/DIG. 10 |
| 3,948,184 | 4/1976 | Pierre et al. | 102/93 |

FOREIGN PATENT DOCUMENTS

| | | | |
|---|---|---|---|
| 2229443 | 5/1974 | Fed. Rep. of Germany | 102/93 |

*Primary Examiner*—Verlin R. Pendegrass

[57] ABSTRACT

There is described a spin stabilized projectile assembly including a projectile, a sabot, and a guide ring. The projectile is provided with a shoulder at the rear end of which abuts the sabot, the projectile and sabot being connected by the guide ring which extends around the projectile and part of the sabot. The guide ring is arranged so that after the projectile assembly has been fired and has left the barrel of the weapon the sabot and the projectile separate. The sabot has a diameter substantially equal to that of the projectile; the guide ring is secured to the sabot against relative movement in a longitudinal direction but is rotatable with respect to the sabot.

7 Claims, 2 Drawing Figures

SPIN STABILIZED PROJECTILE ASSEMBLY

This invention relates to a spin stabilized projectile assembly, wherein the projectile is especially one of annular form with a shoulder at the rear end which abuts a sabot and which is connected therewith by a guide ring extending around the projectile and part of the sabot. The guide ring is arranged so that after the projectile assembly has been fired and has left the barrel of the weapon the sabot and the projectile separate.

According to this invention there is provided an assembly of a spin stabilized projectile with a shoulder at the rear end which bears against a sabot, the projectile and sabot being connected by a barrel guide ring extending around and over the projectile and a cylindrical part of the sabot, the sabot having a diameter substantially equal to the projectile, the guide ring being secured to the sabot against relative movement in a longitudinal direction but being rotatable with respect to the sabot.

The advantages of the projectile assembly are that the guide ring can be made very thin, as it is relieved of the transmission of twist to the sabot. Despite the small cross section, therefore, the guide ring does not suffer from shear forces between the sabot and the projectile, but it will reliably disintegrate after it has left the barrel of the weapon. Only a small volume of material is required for the guide ring, so that it can extend the entire length of the projectile to simplify production. The sabot can be made short, as it requires no longitudinal grooves for the transmission of twist, and is thus of moderate mass, which not only makes it easier to handle but also provides a higher initial velocity for a given propulsive charge and enables a good flight trajectory to be obtained.

Figure 1:
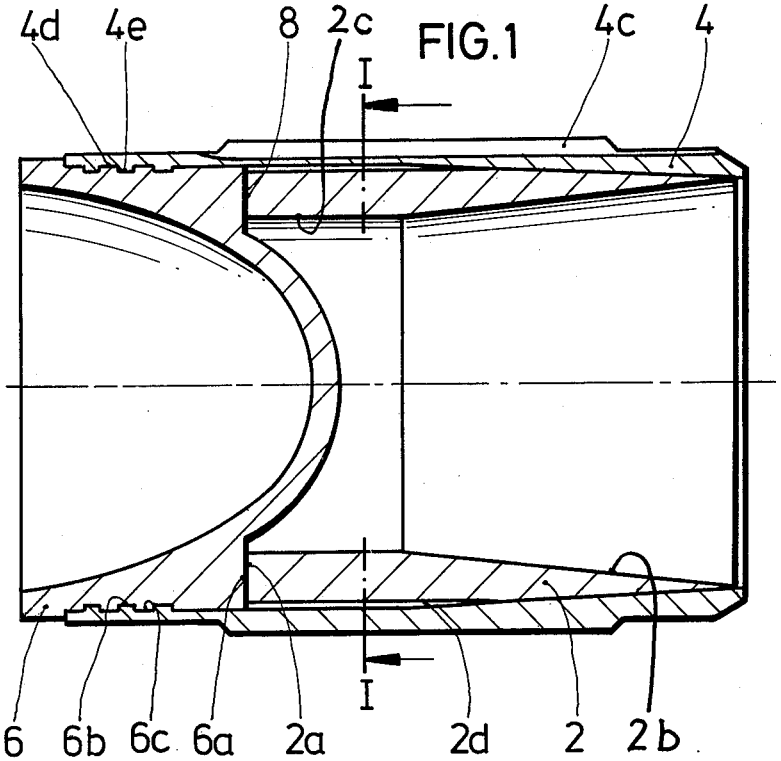
Figure 2:
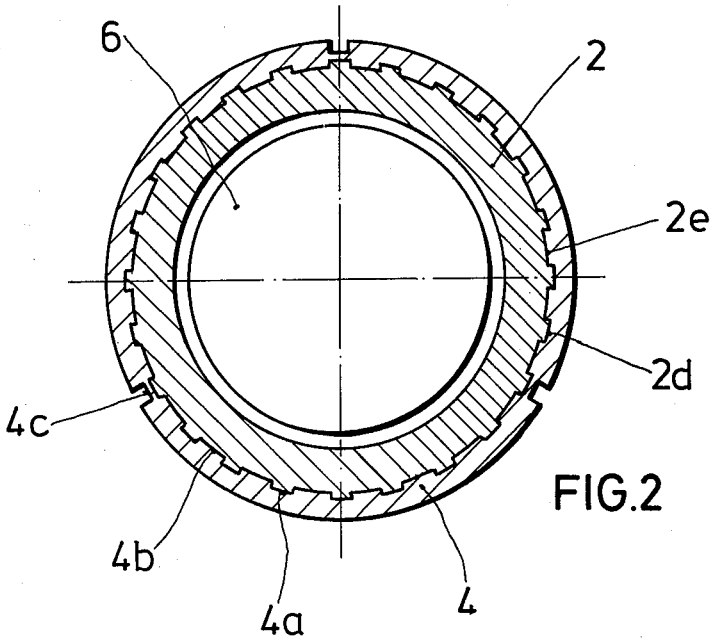

An embodiment according to the invention is described by way of example with reference to the accompanying drawings, wherein:

FIG. 1 is a view in longitudinal section through an annular projectile and sabot, and FIG. 2 is a view in cross section on the line I-I of FIG. 1.

In the projectile assembly shown an annular projectile 2 is surrounded by a guide ring 4 which connects it with a sabot 6. The projectile 2 has a rear shoulder 2*a* which bears against a shoulder 6*a* of the sabot 6. The bore of the annular projectile 2 shown has a forward conical tapered part 2*b* and a rear cylindrical bore 2*c*; however, it may be cylindrical overall. On the periphery of the projectile there are ridges 2*d* and grooves 2*e*, extending longitudinally and engaged by corresponding ridges 4*b* and grooves 4*a* of the guide ring 4. The grooves 2*d* and ridges 2*e* may be positioned at a small angle with respect to the longitudinal axis of the assembly, which assists the twisting action. The grooves 2*d* and the ridges 2*e* may, however, be replaced by knurling.

The longitudinal grooves and ridges ensure the transmission of twist from the guide ring 4 to the projectile 2. As the longitudinal grooves and ridges extend over the greater part of the length of the projectile 2, transmission of the twist is reliably ensured even at a very high initial velocity with the attendant high acceleration. This enables the guide ring to be of a material of comparatively moderate strength.

The guide ring 4 extends over a cylindrical part of the sabot 6 and is provided with grooves 4*d* and ridges 4*e* extending in a peripheral direction which engage corresponding ridges 6*c* and grooves 6*b* of the sabot 6. This secures the ring and sabot together.

The external diameter of the ring 4 at this position is less than the diameter of the barrel bore of the weapon, so that the ring 4 will not be pressed against the sabot 6 during passages of the projectile assembly through the barrel. The peripheral grooves and ridges engage one another without pressure, and the guide ring 4 is able to rotate relative to the sabot 6. Thus little or no twist acceleration is imparted to the sabot on firing.

To prevent binding or seizing the shoulder 2*a* of the projectile 2 and the shoulder 6*a* of the sabot 6 a lubricant 8 which may be molybdenum disulphide of polytetrafluorethylene is placed between them.

To ensure immediate and reliable separation of the guide ring 4 and the sabot 6 from the projectile 2 after they have left the barrel of the weapon, the periphery of the guide ring has a number of weak fracture points (three shown) in the form of grooves 4*c*, evenly angularly distributed thereabout and extending in the longitudinal direction. These ensure that the ring will mushroom on leaving the muzzle and that the guide ring and sabot will decelerate quickly due to air resistance.

The guide ring 4 may be made of a plastic material. To enable the ring of plastic material to be placed around the projectile and the sabot, either a prestretched plastic, which shrinks under the action of heat, can be used, this being drawn in the form of a cylindrical casing over the projectile and sabot and then heated. The plastic will shrink and fit firmly against the projectile and sabot filling the grooves provided in them. The plastic guide ring 4 can then be machined down to the required dimensions. As an alternative, the plastic ring 4 may equally well be made of a thermoplastic material capable of being injection molded, in which case it is molded around the projectile. In such cases it is possible to dispense with subsequent machining.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A spin stabilized projectile assembly, comprising an annular projectile, a sabot, the projectile having a shoulder at the rear end which bears against the sabot, a barrel guide ring connecting the projectile and the sabot, said sabot having a diameter substantially equal to that of the projectile, the barrel guide ring extending around and over the projectile and a cylindrical part of the sabot, the guide ring being secured to the sabot against relative movement therebetween in a longitudinal direction but being rotatable with respect to the sabot.

2. A projectile assembly in accordance with claim 1, wherein the guide ring is secured to the projectile by engaging grooves and ribs extending substantially longitudinally whereby relative rotation between the guide ring and projectile is prevented, the guide ring being secured to the sabot by engaging grooves and ribs extending circumferentially to permit relative rotation between the guide ring and the sabot.

3. A projectile assembly in accordance with claim 1, wherein the guide ring is made of a plastic material in the form of a casing extending over the entire length of the projectile and part of the length of the sabot.

4. A projectile assembly in accordance with claim 3, wherein the casing is pre-stretched plastic material which is heat shrinkable.

5. A projectile assembly in accordance with claim 3, wherein the casing is made of a plastic material which is molded around the projectile.

6. A projectile assembly in accordance with claim 1, wherein a lubricant is provided between the engaging surfaces of the projectile and sabot.

7. A spin stabilized projectile assembly, comprising an annular projectile, a sabot, the projectile having a shoulder at the rear end which bears against the sabot, a barrel guide ring connecting the projectile and the sabot, said sabot having a diameter substantially equal to that of the projectile, the barrel guide ring extending around and over the projectile and a cylindrical part of the sabot, the guide ring being secured to the sabot against relative movement therebetween in a longitudinal direction but being rotatable with respect to the sabot, and the guide ring is secured to the projectile so that relative rotation between the guide ring and projectile is prevented.

* * * * *